US012385252B2

(12) United States Patent
Wu et al.

(10) Patent No.: US 12,385,252 B2
(45) **Date of Patent: *Aug. 12, 2025**

(54) REBAR CAGE MODULE FOR BEAM REINFORCEMENT SYSTEM AND MANUFACTURING METHOD OF BEAM REINFORCEMENT SYSTEM

(71) Applicant: CHIEN KUO CONSTRUCTION CO., LTD., Taipei (TW)

(72) Inventors: Chang-Shiou Wu, Taipei (TW); Sheng-Yi Yen, Taipei (TW); Chia-Hsuan Huang, Taipei (TW)

(73) Assignee: CHIEN KUO CONSTRUCTION CO., LTD., Taipei (TW)

( * ) Notice: Subject to any disclaimer, the term of this patent is extended or adjusted under 35 U.S.C. 154(b) by 239 days.

This patent is subject to a terminal disclaimer.

(21) Appl. No.: 17/964,380

(22) Filed: Oct. 12, 2022

(65) Prior Publication Data

US 2023/0110325 A1 Apr. 13, 2023

(30) Foreign Application Priority Data

Oct. 12, 2021 (TW) ..... 110137844

(51) Int. Cl.
*E04C 5/06* (2006.01)

(52) U.S. Cl.
CPC ..... *E04C 5/0622* (2013.01)

(58) Field of Classification Search
CPC .... E04C 5/0622; E04C 5/0609; E04C 5/0604; E04G 13/04; E04G 17/06; E04G 11/12
See application file for complete search history.

(56) References Cited

U.S. PATENT DOCUMENTS 7,143,554 B2 * 12/2006 Sachs ..... E04C 3/20 52/251
2012/0233936 A1 * 9/2012 Zhong ..... E04B 1/34823 52/173.1

(Continued)

FOREIGN PATENT DOCUMENTS

DE 202005005636 U1 * 9/2005 ..... E04C 5/0622
DE 102011002781 A1 * 7/2012 ..... E04C 5/0613

(Continued)

*Primary Examiner* — Theodore V Adamos
(74) *Attorney, Agent, or Firm* — Muncy, Geissler, Olds & Lowe, P.C.

(57) ABSTRACT

The present invention provides a rebar cage module comprising a first opening rebar net and a second opening rebar net. The first opening rebar net extends from a central direction, and partially forms an elongated groove shape enclosing a first accommodating portion, and has a first opening. The second opening rebar net extends from the central direction, and partially surrounds the central direction to form an elongated groove shape, and has a second opening oriented to the opposite direction with the first opening. Wherein, the first opening rebar net at least partially covers the second opening rebar net, the first opening rebar net is at least partially distributed in the second opening, and the first opening rebar net extends at least partially through the second opening into the second accommodating portion, and making the first accommodating portion and the second accommodating portion at least partially overlap.

10 Claims, 12 Drawing Sheets

(56) References Cited

U.S. PATENT DOCUMENTS

| | | | | |
|---|---|---|---|---|
| 2013/0305652 | A1* | 11/2013 | Iihoshi | E04C 5/0622 52/664 |
| 2022/0268024 | A1* | 8/2022 | Yin | E04C 5/0622 |
| 2023/0110083 | A1* | 4/2023 | Wu | E04C 5/0609 52/677 |

FOREIGN PATENT DOCUMENTS

| | | | | |
|---|---|---|---|---|
| ES | 2264875 | B1 * | 2/2008 | E04C 5/0604 |
| ES | 2292286 | A1 * | 3/2008 | E04C 5/0609 |
| JP | 2001020376 | A * | 1/2001 | E04C 5/0609 |

* cited by examiner

REBAR CAGE MODULE FOR BEAM REINFORCEMENT SYSTEM AND MANUFACTURING METHOD OF BEAM REINFORCEMENT SYSTEM

BACKGROUND OF THE INVENTION

1. Field of the Invention

The present invention relates to a rebar cage module; specifically relates to a rebar cage module for beam reinforcement system and a manufacturing method of the beam reinforcement system.

2. Description of the Prior Art

The current domestic stirrups are configured to be bonded on the main bars so as to form reinforcement structure in the structure of the reinforced concrete. Stirrups play a plurality of roles in the reinforced concrete such as resisting shear force, preventing main bars being buckled, and confining concretes in the core regions and the like. The stirrup structures in current technology can be disposed on the surface across the main bars, so that hooping force can be distributed evenly across the cross-section of the beam. However, it is not convenient to add more main bars after the stirrups have been disposed and it takes longer time to do so. Therefore, it is essential to solve problems in the current arts so as to enhance convenience of construction and shortening its manufacturing time.

SUMMARY OF THE INVENTION

The present invention mainly intends to provide a rebar cage module for beam reinforcement system to shorten the construction time of the beam reinforcement system. The rebar cage module of the present invention includes a first opening rebar net and a second opening rebar net. The first opening rebar net has a first opening, and the first opening rebar net extends along a central direction and partially surrounds the central direction to form an elongated groove shape enclosing a first accommodating portion. The second opening rebar net has a second opening, and the second opening rebar net extends along the central direction and partially surrounds the central direction to form an elongated groove shape enclosing a first accommodating portion. And the second opening and the opening are oriented in opposite directions. Wherein the first opening rebar net at least partially covers the second opening rebar net, the first opening rebar net is at least partially distributed on the second opening and extends into the second accommodating portion passing through the second opening, so that the first accommodating portion and the second accommodating portion are overlapped with each other.

Another embodiment of the rebar cage module includes an upper-opening rebar net having an upper opening and a lower-opening rebar net having a lower opening. Wherein the upper opening and the lower opening are oriented in opposite directions. The upper-opening rebar net includes a plurality of upper-opening rebars arranged in parallel, a first traverse rib, and a second traverse rib. The first traverse rib is configured to connect one side of the plurality of upper-opening rebars. The second traverse rib is configured to connect to the other side of the plurality of upper-opening rebars opposite to the first traverse rib. A third traverse rib is configured to connect the plurality of upper-opening rebars and arranged in parallel with the first traverse rib.

The lower-opening rebar net includes a plurality of lower-opening rebars arranged in parallel, a fourth traverse rib, and a fifth traverse rib. The fourth traverse rib is configured to connected to one side of the plurality of lower-opening rebars. The fifth traverse rib is configured to be connected to the other side of the plurality of lower-opening rebars opposite to the fourth rib, and arranged in parallel with the fourth traverse rib. Wherein the upper-opening rebars at least partially covers the lower-opening rebars, and the upper-opening rebars are at least partially distributed on the lower opening. The second traverse rib is arranged in parallel.

In order to achieve the aforementioned purposes, the manufacturing method of the beam reinforcement system of the present invention includes following steps: providing two first main bars in parallel; hanging a plurality of stirrups on the two first main bars, wherein the stirrups include two erect bar portions in parallel, and a bottom rib connecting bottom ends of two erect bar portions; providing the first opening rebar net of the rebar cage module on the plurality of bottom ribs; providing a plurality of second main bars on the plurality of bottom ribs and the first bottom ribs of the first opening rebar net via the first opening, and housing it in the plurality of second main bars via the accommodating portion of first opening rebar net; wherein the plurality of second main bars and the plurality of third traverse ribs are arranged in parallel; providing a plurality of third main bars on a top portion of the second opening rebar net; wherein the two first main bars and the plurality of third main bars are arranged in parallel, and the two first main bars are hooked on the plurality of third main bars transversely via a hanging portion the second opening rebar net; providing the second opening rebar net covered with the first opening rebar net each other; and providing a plurality of stirrup caps on the first opening rebar net; wherein the stirrup caps are disposed corresponding to the plurality of openings.

DETAILED DESCRIPTION OF THE PREFERRED EMBODIMENT

In order to make people skilled in the art further understand the purposes, the structures, and the effects of the present invention, the present invention will be described in detail using preferred embodiments with reference to drawings.

The present invention provides rebar cage module for beam reinforcement system and the manufacturing method thereof. Firstly, FIG. 1 and FIG. 2 illustrates a first embodiment of the structure of the rebar cage module of the present invention.

First Embodiment

Figure 1:
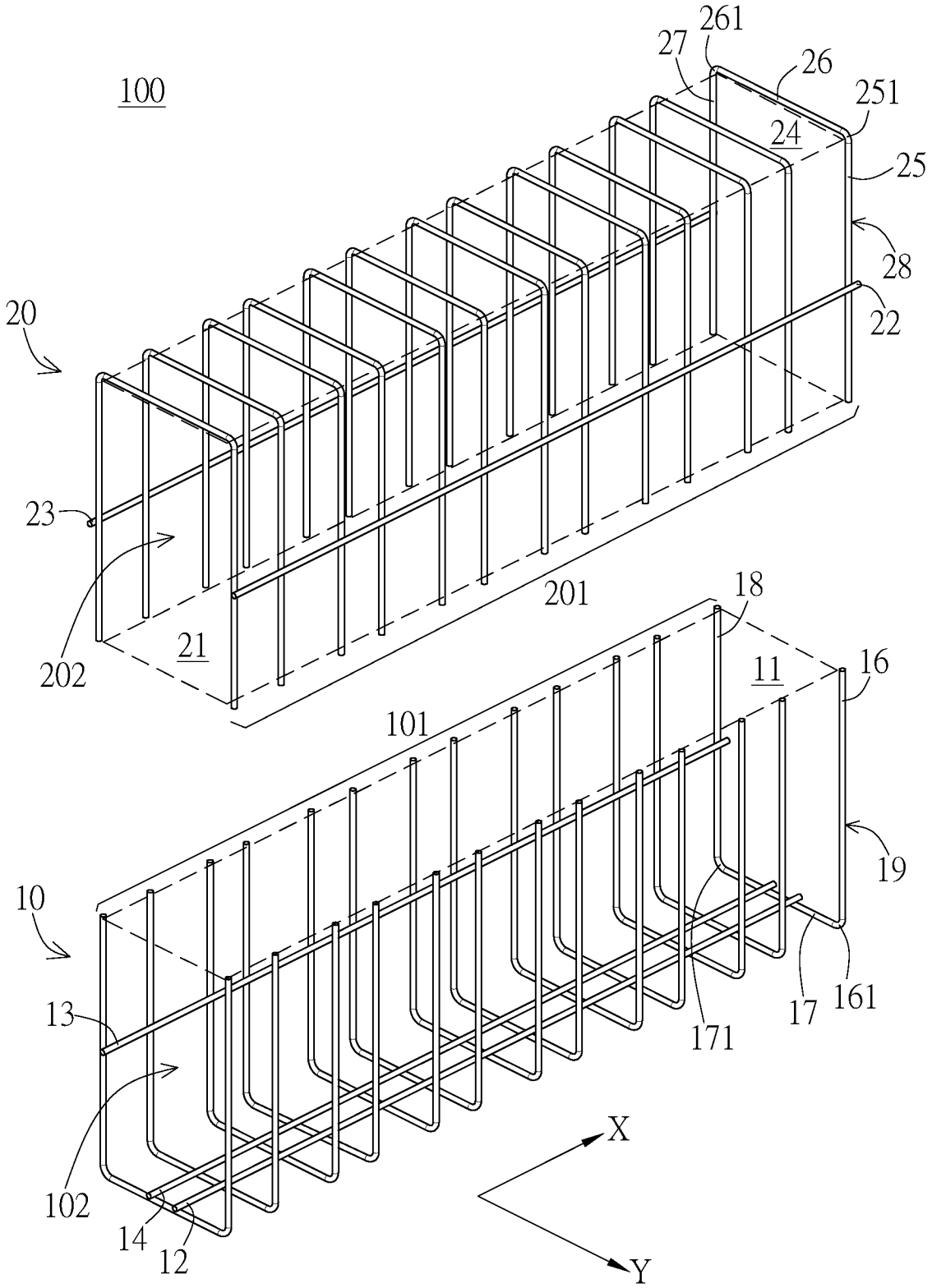
FIG. 1 is a perspective view of the first embodiment of the rebar cage module of the present invention.
Figure 2:
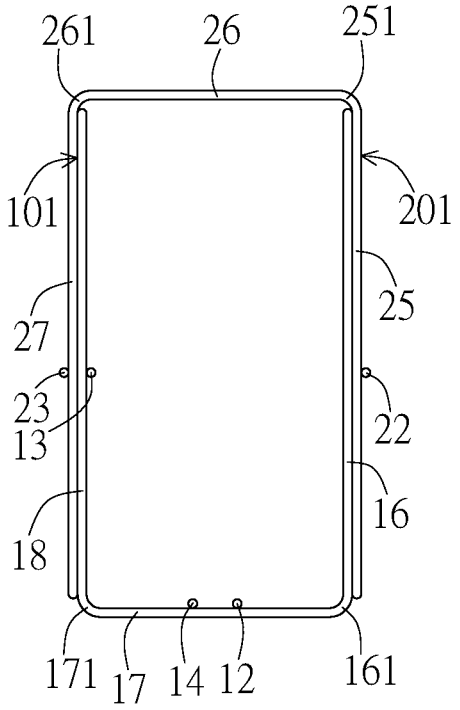
FIG. 2 is a side view of the first embodiment of the rebar cage module of the present invention.

As illustrated in FIG. 1 and FIG. 2, a rebar cage module 100 of the present invention includes a first opening rebar net 10 and a second opening rebar net 20. The first opening rebar net 10 includes a first body 101, a first traverse rib 12, a second traverse rib 13, and a third traverse rib 14. The first body 101 extends along a central direction X and partially surrounds the central direction X to form an elongated groove shape to enclose a first accommodating portion 102, and has a first opening 11. Specifically, the first opening 11 is located on a surface of the first opening rebar net 10 facing the second opening rebar net 20, and located on a plane where the central direction X and a radial direction Y illustrated in FIG. 1 exist. It can immediately extend into the first accommodating portion 102 after passing through the first opening 11. The first traverse rib 12 is configured connect one side of the first opening rebar net 10, for example as illustrated in FIG. 1, extends along the central direction X to be provided on the first accommodating portion 102 of the first body 101; specifically provided on the bottom portion of the first accommodating portion 102 opposite to the first opening 11; the second traverse rib 13 is configured to connect the other side of the first opening rebar net 10, for example, as illustrated in FIG. 1, extends along the central direction X to be provided on a side portion of the first accommodating portion 102 of the first body 101; and the third traverse rib 14 is configured to connect the one side of the first opening rebar net 10 and is arranged in parallel with the first traverse rib 12; that is, the third traverse rib 14 and the first traverse rib 12 are arranged in parallel on the same side of the first opening rebar net 10. In addition, the third traverse rib 14 and the first traverse rib 12 are arranged in parallel on the plane where the central direction X and the radial direction Y exist.

the second opening rebar net 20 includes a second body 201, a fourth traverse rib 22, and a fifth traverse rib 23. The second body 201 extends along the central direction X and partially surrounds the central direction X to form an elongated groove shape to enclosing a second accommodating portion 202. Specifically, the second opening 21 is located on a surface of the second opening rebar net 20 facing the first opening rebar net 10, and is located on a plane where the central direction X and the radial direction Y illustrated in FIG. 1 exist. It can immediately extend into the second accommodating portion 202 after passing through the second opening 21. In addition, the second opening 21 and the first opening 11 are oriented in opposite directions each other.

As illustrated in FIG. 1 and FIG. 2, the fourth traverse rib 22 is configured to connect one side of the second opening rebar net 20, for example, as illustrated in FIG. 1, extends along the central direction X to be provides on a side portion of the second body 201; the fifth traverse rib 23 is provided on the other side opposite to the fourth traverse rib 22, for example, as illustrated in FIG. 1, extends along the central direction X to be provided on a side of the second body 201 opposite to the fourth traverse rib 22, so that the fifth traverse rib 23 and the fourth traverse rib 22 are respectively provided on side portions of the second body 201. In addition, the fifth traverse rib 23 and the fourth traverse rib 22 are arranged in parallel on the same plane along the radial direction Y. A hanging portion 24 is located on a bottom portion of the second body 201 and is configured to be hooked on at least one main bar. Preferably, each of the traverse ribs is connected to the first body 101 or the second body 201 by spot welding, but not limited thereto.

The first opening rebar net 10 at least partially covers the second opening rebar net 20 to be at least partially distributed on the second opening 21. In addition, the second traverse rib 13 and the fifth traverse rib 23 are arranged in parallel. Specifically, as illustrated in FIG. 2, when the first body 101 at least partially covers the second body 201, the first body 101 at least partially passes through the second body 201 to extend into the second accommodating portion 202, so that the first accommodating portion 102 and the second accommodating portion 202 are at least partially overlapped with each other.

In the embodiment illustrated in FIG. 2, each of the first traverse rib 12, the second traverse rib 13, and the third traverse rib 14 is provided on inner side of the first body 101; each of the fourth traverse rib 22 and the fifth traverse rib 23 is provided on an outer side of the second body 201. Specifically, when the first body 101 at least partially covers the second body 201, the first traverse rib 12, the second traverse rib 13, and the third traverse rib 14 of the first body 101 is provided on a space surrounded by the first body 101 and the second body 201; each of the fourth traverse rib 22 and the fifth traverse rib 23 of the second body 201 is outside the space surrounded by the first body 101 and the second body 201, so that the second traverse rib 13 of the first body 101 and the fifth traverse rib 23 of the second body 201 are arranged in parallel. Through such an arrangement, interfacing between each traverse ribs at assembling can be reduced so as to enhance convenience of assembling.

Furthermore, as illustrated in FIG. 1 and FIG. 2, the first opening 11 of the first opening rebar net 10 may be an upper opening; the second opening 21 of the second opening rebar net 20 may be a lower opening. The first body 101 may include a plurality of upper-opening rebars 19. In addition, each of the upper-opening rebars 19 includes a first erect bar portion 16, a first bottom erect bar portion 17, and a second erect bar portion 18. The first erect bar portion 16 has a first bend portion 161; the first bottom rib 17 is bended from the first bend portion 161 relative to the first erect bar portion 16 and extends into a second bend portion 171. The second erect bar portion 18 is bended from the second bend portion relative to the first bottom rib 17, and is arranged in parallel with the first erect bar portion 16. Wherein the upper opening 11 is an opening formed on an end opposite to the first bottom rib 17. On the other and, the first accommodating portion 102 is surrounded by the first erect bar portion 16, the first bottom rib 17, and the second erect bar portion 18.

The second body 201 includes a plurality of lower-opening rebars 28, and the lower-opening levers 28 include a third erect bar portion 25, a second bottom rib 26, and a fourth erect bar portion 27. The third erect bar portion 25 has a third bend portion 251; the second bottom rib 26 is bended from the third bend portion 251 relative to the third erect bar portion 25 and extend into the fourth bend portion 261. The fourth erect bar portion 27 is bended from the fourth bend portion 261 relative to the second bottom rib 2, and is arranged in parallel with the third erect bar portion 25. Wherein the lower opening 21 is an opening formed on an end opposite to the second bottom rib 26. On the other hand, the second bottom rib 26 may form a hanging portion configured to be hooked on at least one main bar transversely. The aforementioned erect bar portions, the bottom ribs, and the connections therebetween are integrally formed by bending single piece of steel bar and each of the traverse ribs and each of the erect bar portions or bottom ribs are preferably connected by spot welding, but not limited thereto.

Second Embodiment

Figure 3:
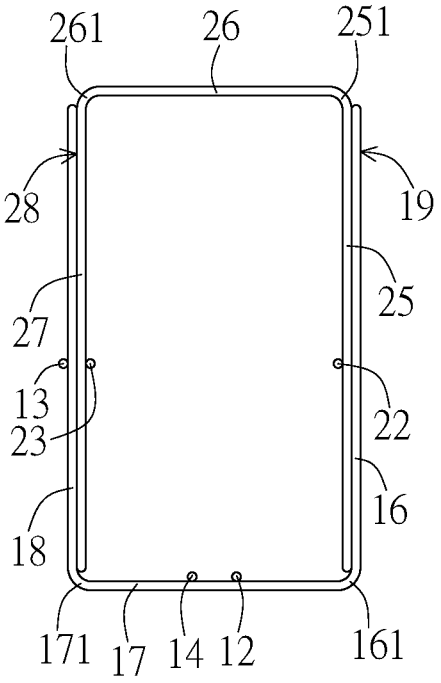
FIG. 3 is a side view of the second embodiment of the rebar cage module of the present invention.

As illustrated in FIG. 3, the second embodiment is different from the first embodiment in the way of covering between the first opening rebar net 10 and the second opening rebar net 20. Wherein each of the first traverse rib 12 and the third traverse rib 14 is provided inside the first opening rebar net 10; the second traverse rib 13 is provided outside the upper-opening rebars 19; each of the fourth traverse rib 22 and the fifth traverse rib 23 is disposed inside the second opening rebar net 20. Specifically, when the first opening rebars 19 and the second opening rebars 28 are overlapped with each other, the second traverse rib 13 is provided outside the space surrounded by the first opening rebars 19 and the second opening rebars 28. Each of the first traverse rib 12, the third traverse rib 14, the fourth traverse rib 22, and the fifth traverse rib 23 is inside the space surrounded by the first opening rebars 19 and the second opening rebars 28.

Third Embodiment

Figure 4:
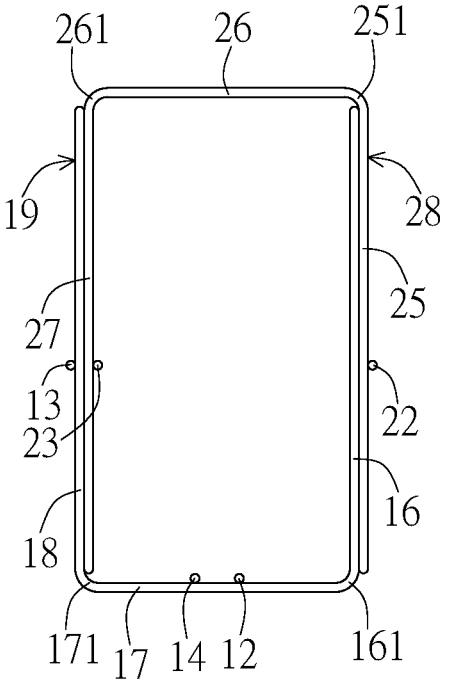
FIG. 4 is a side view of the third embodiment of the rebar cage module of the present invention.

As illustrated in FIG. 4, third embodiment is different from the first embodiment in the covering way between the upper-opening rebar net 10 and the lower-opening rebar net 20. The first traverse rib 12 and the third traverse rib 14 are provided inside the first opening rebars 19, the second traverse rib 13 is provide outside the first opening rebars 19; the fourth traverse rib 22 is provided outside the second opening rebars 28, the fifth traverse rib 23 is provided inside the second opening rebars 28. Specifically, when the first opening rebars 19 at least partially cover the second opening rebars 28, the second traverse rib 13 and the fourth traverse rib 22 are provided outside the space surrounded by the first opening rebars 19 and the second opening rebars 28. The first traverse rib 12, the third traverse rib 14, and the fifth traverse rib 23 are provided outside the space surrounded by the first opening rebars 19 and the second opening rebars 28.

Figure 5:
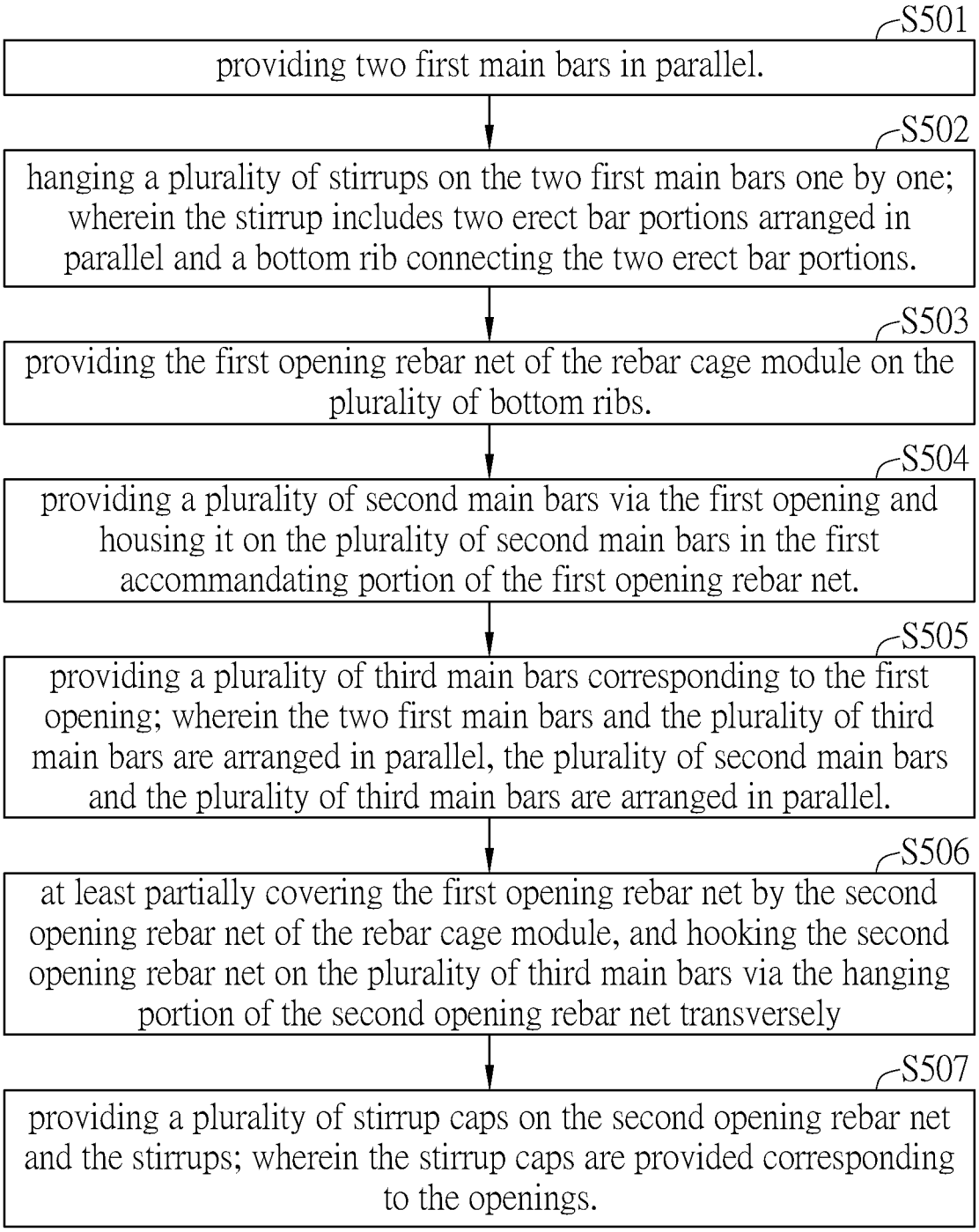
FIG. 5 is a diagram of main steps of an exemplary manufacturing method of the beam reinforcement system.

Please refer to FIG. 5 illustrating main steps of an exemplary manufacturing method of the beam reinforcement system of the present invention, and the first embodiment of the present invention for example.

Figure 6:
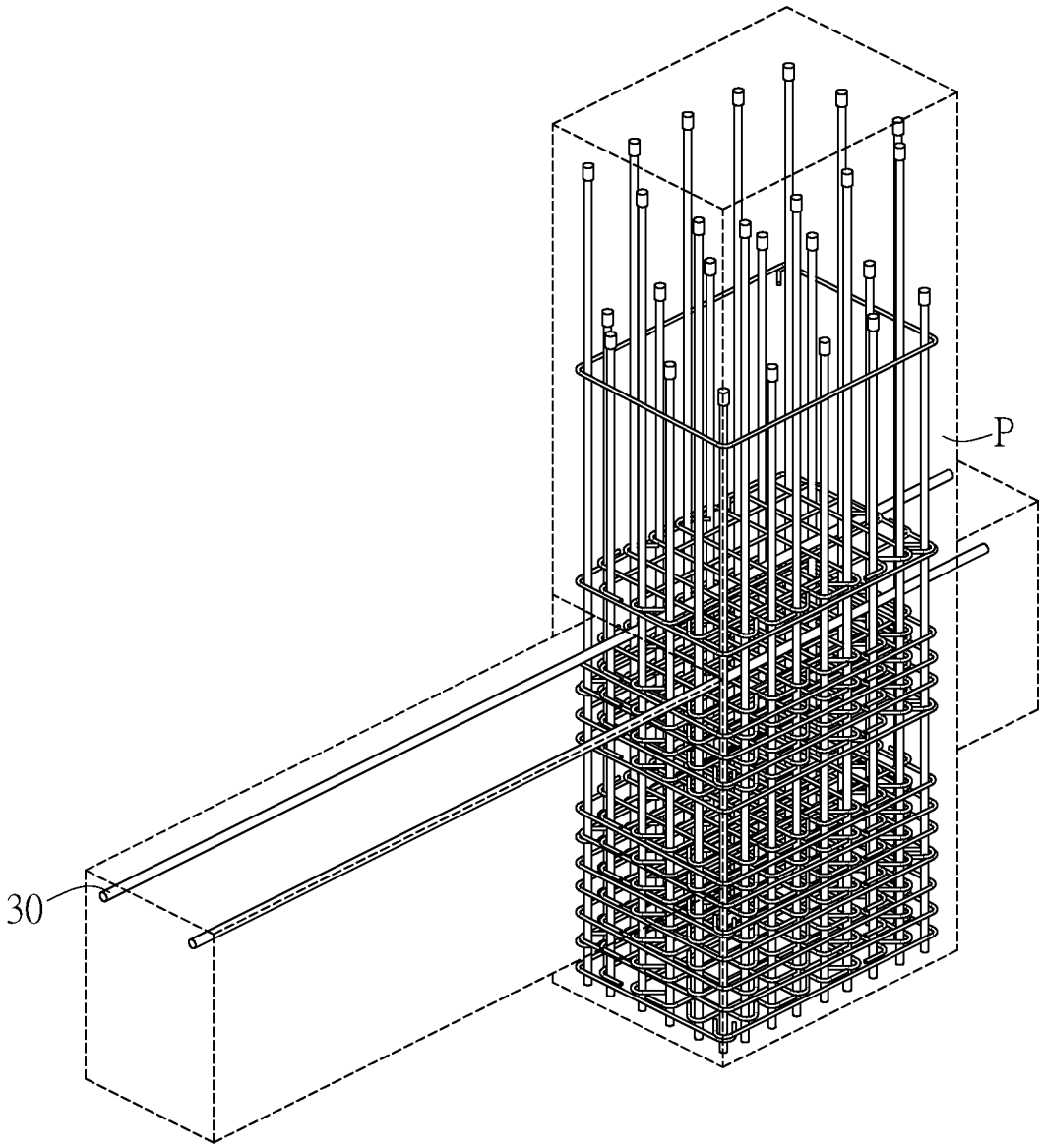
FIG. 6 shows the state in the main step 1 of the exemplary manufacturing method of the present invention.

The exemplary manufacturing method of the present embodiment starts at step S501: providing two first main bars 30 in parallel. Specifically, as illustrated in FIG. 6, the two first main bars 30 are provided to pass through the vertical reinforcing steel body P in a parallel direction, and the two first main bars 30 are parallel with each other in the traverse surface.

Figure 7:
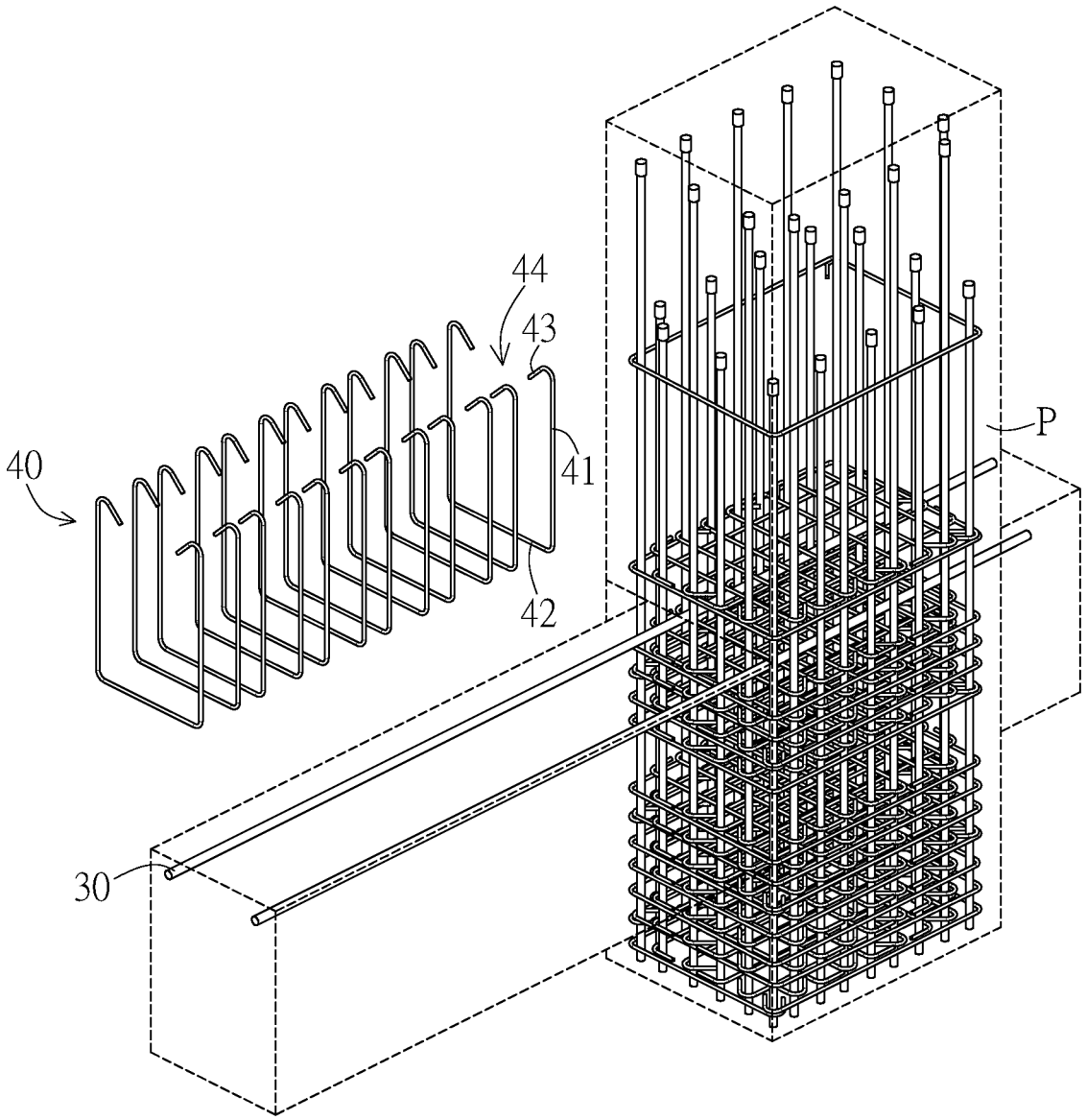
FIG. 7 shows the state in the main step 2 of the exemplary manufacturing method of the present invention.

Then the method is proceeded to step S502: hanging a plurality of stirrups 40 on the two first main bars 30 one by one, wherein the stirrup 40 includes two erect bar portions 41 arranged in parallel and a bottom rib 42 connecting the two erect bar portions. Specifically, as illustrated in FIG. 7, the stirrup 40 further includes hook ends 43 and a stirrup opening 44. The hook ends 43 extend at top ends of the two erect bar portions 41 arranged in parallel, so that the plurality of stirrups 40 are hooked on the first main bars 30 via the hook ends 43, so that the plurality of stirrups 40 are hanged on the two first main erect bar portions 30. The stirrup opening 44 are formed on an end opposite to the bottom rib 42 for providing rebar cage module 100.

Figure 8:
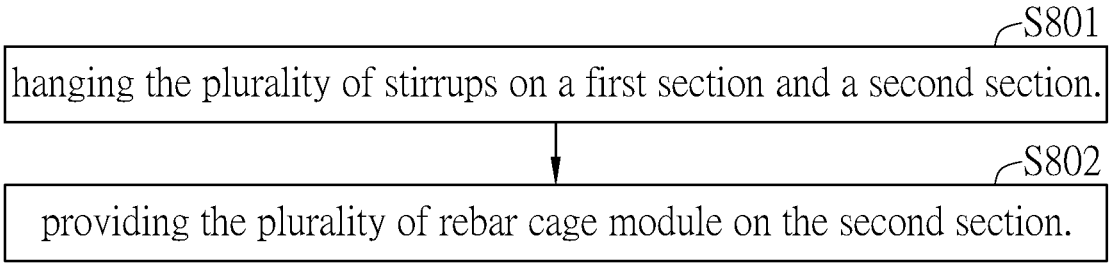
FIG. 8 is a flowchart of the detailed steps of the exemplary manufacturing method of the beam reinforcement system of the present invention.
Figure 9:
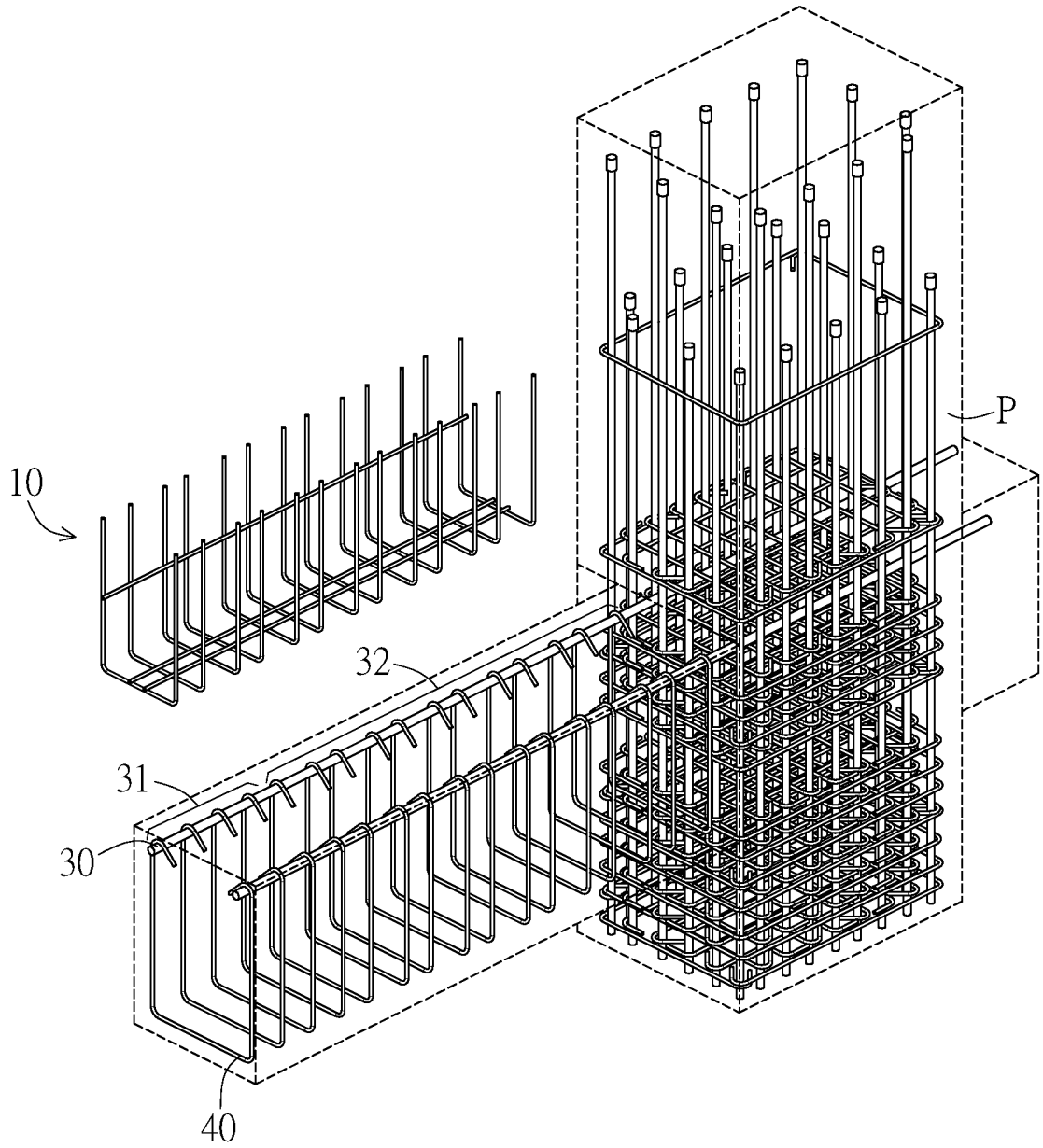
FIG. 9 shows the state in the detailed step of the exemplary manufacturing method of the present invention.

In addition, the exemplary manufacturing method of the beam reinforcement system of the present invention further includes detailed steps illustrated in FIG. 8. The exemplary manufacturing method of the present invention is proceeded to detailed step S801: hanging the plurality of stirrups 40 on a first section 31 and a second section 32. Specifically, as illustrated in FIG. 8 and FIG. 9, the stirrups 40 are hanged on the first section 31 and the second section 32 of the first main bars 30 in advance.

Then the method is proceeded to detailed step S802: providing the plurality of rebar cage module 100 on the second section 32. Specifically, as illustrated in FIG. 9, the rebar cage module 100 is provided inside the stirrups 40 via the stirrup openings 44, and the rebar cage module 100 is provided on the second section 32.

Figure 10:
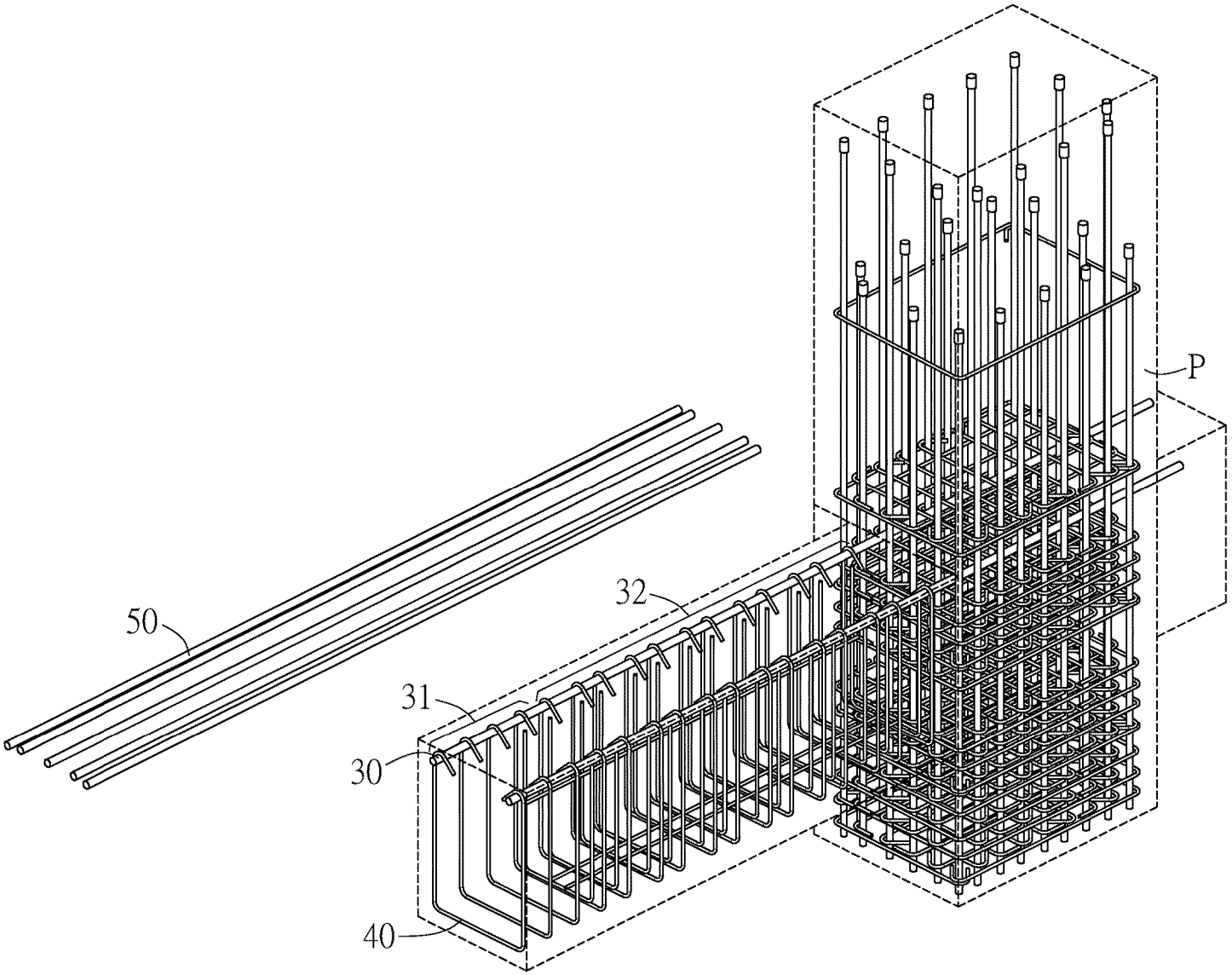
FIG. 10 shows the state in the main step 3 of the exemplary manufacturing method of the present invention.

The exemplary manufacturing method is proceeded to step S503: providing the first opening rebar net 10 of the rebar cage module 100 on the plurality of bottom ribs 42. Specifically, as illustrated in FIG. 10, the first opening rebar net 10 is provided on the plurality of bottom ribs 42 in advance and they are bonded and fixed on the plurality of stirrups 40 via fixed members. The fixed members in the preferred embodiment of the present invention are iron wires; however, materials and appearances of the fixed members are not limited thereto in the actual application. Please further refer to FIG. 8, the step S503 may include detailed step S801: hanging the plurality of stirrups 40 on the first section 31 and the second section 32. Specifically, as illustrated in FIG. 9, the rebar cage module 100 is hanged on the second section 32 of the first main bars. The first section 31 and the second section 32 in the present embodiment respectively correspond to a plastic region and non-plastic region in the actual application. The second section 32 is a section closed to the vertical reinforcing steel body P, and make the hooping force of the main bars of the bean reinforcement system of the present invention along a vertical direction be distributed evenly.

Figure 11:
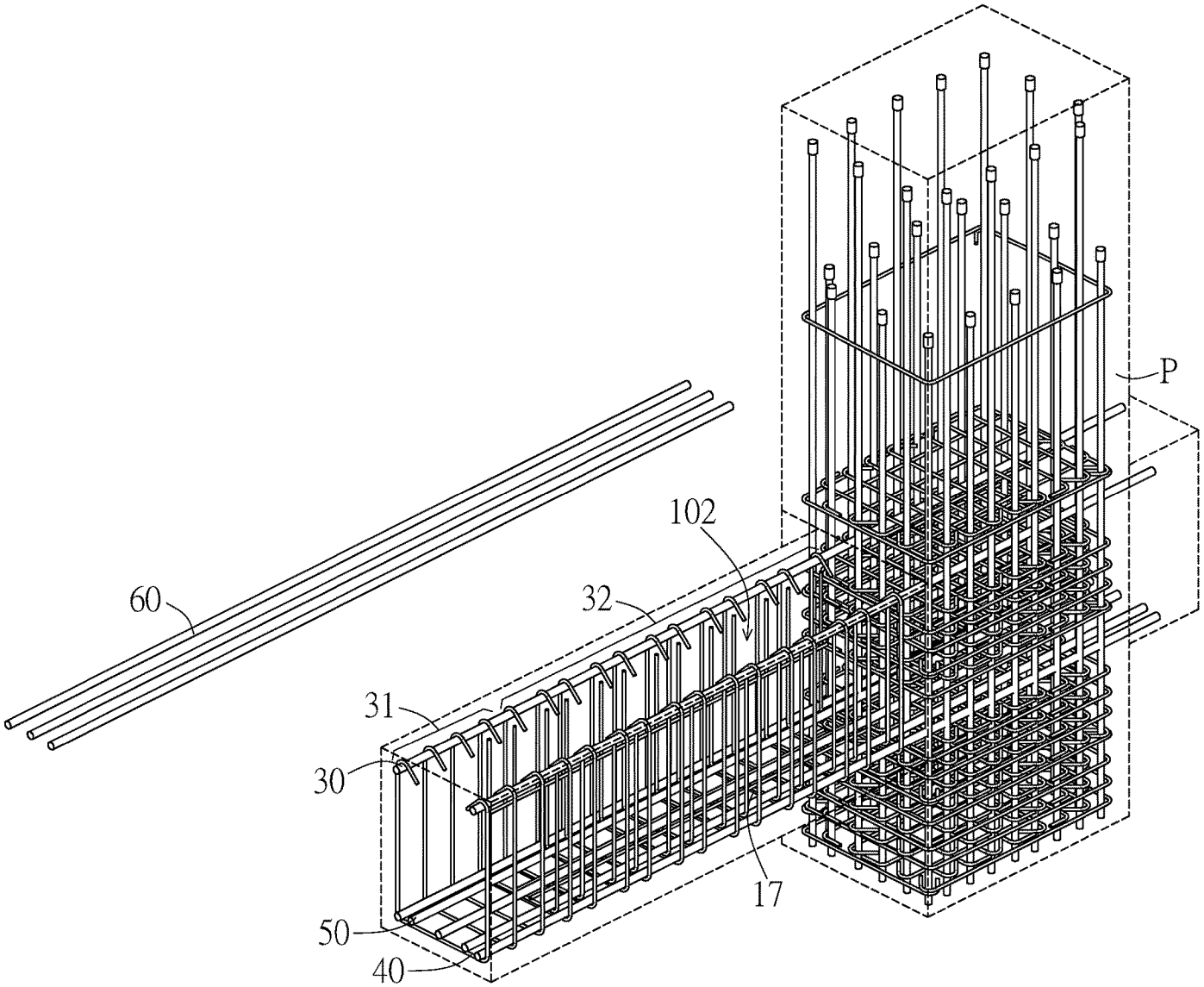
FIG. 11 shows the state in the main step 4 of the exemplary manufacturing method of the present invention.

Then the exemplary manufacturing method is proceeded to step S504: providing a plurality of second main bars 50 via the first opening 11 and housing it on the plurality of second main bars 50 in the first accommodating portion 102 of the first opening rebar net 10. Specifically, as illustrated in FIG. 11, when the second main bars 50 can pass through the vertical reinforcing steel body P, the second main bars 50 are provided on the first accommodating portion 102 of the first opening rebar net 10 and are arranged on the first bottom rib 17. In addition, some of the second main bars 50 are provided on the bottom rib 42 via a gap between the stirrups 40 and the first opening rebar net 10.

Figure 12:
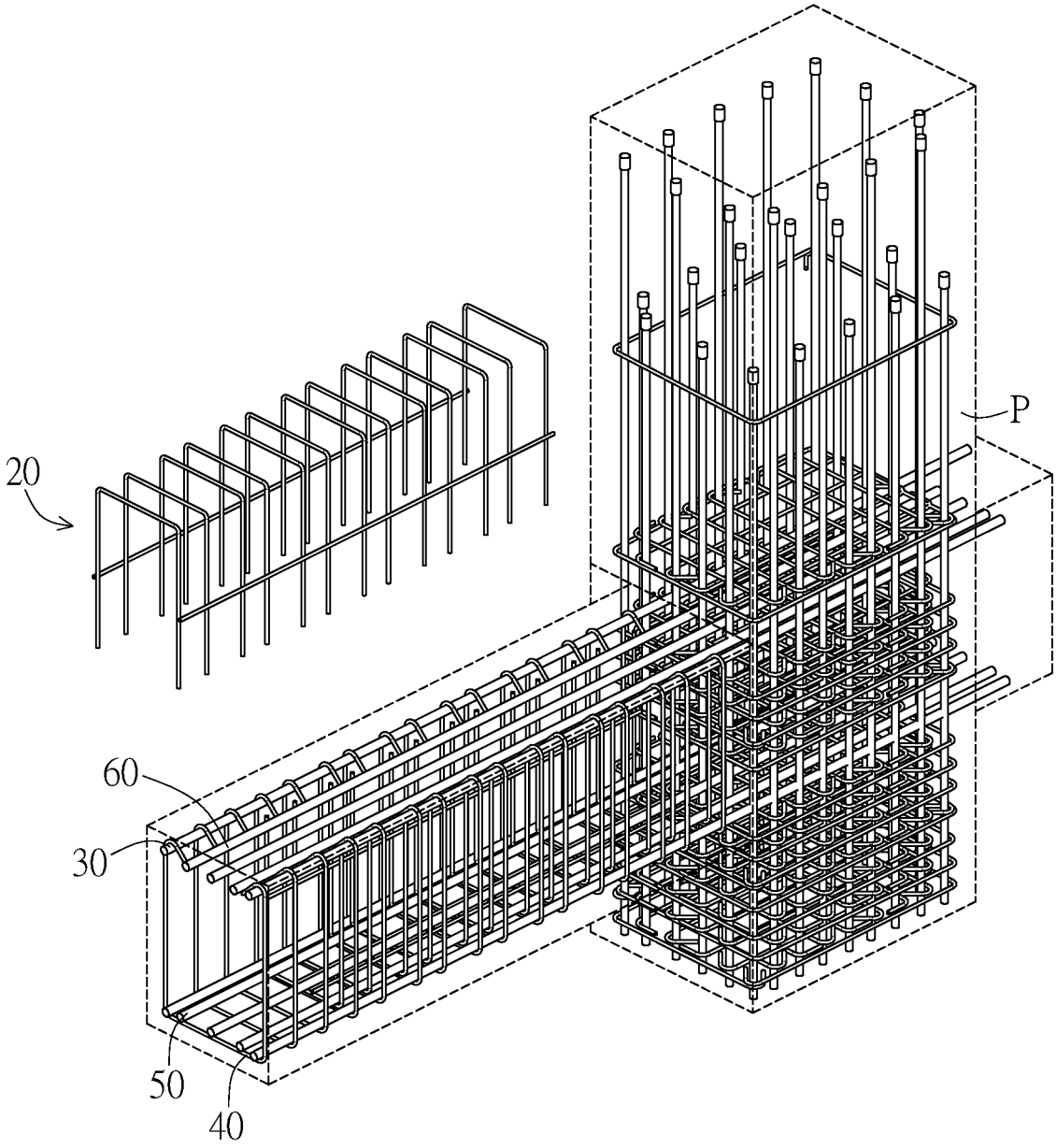
FIG. 12 shows the state in the main step 5 of the exemplary manufacturing method of the present invention.

Then, the exemplary manufacturing method is proceeded to step S505: providing a plurality of third main bars 60 corresponding to the first opening 11. Wherein the two first main bars 30 and the plurality of third main bars 60 are arranged in parallel, the plurality of second main bars 50 and the plurality of third main bars 60 are arranged in parallel. Specifically, as illustrated in FIG. 12, the plurality of third main bars 60 can pass through the vertical reinforcing steel body P, and they are bonded thereon via the fixed members. In addition, they are arranged in parallel with the first main bars 30 each other on the same traverse surface.

Figure 13:
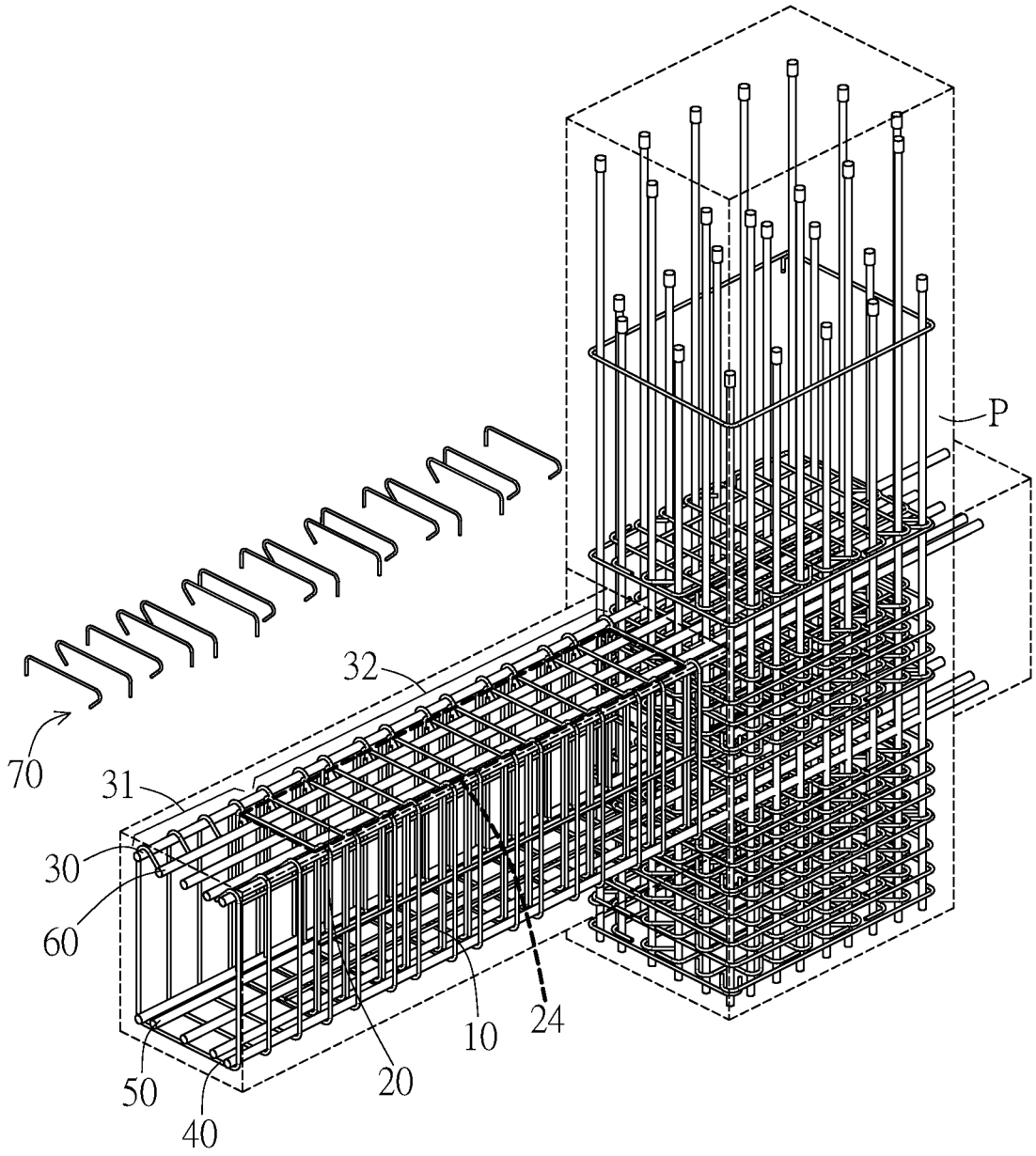
FIG. 13 shows the state in the main step 6 of the exemplary manufacturing method of the present invention.

Then, the exemplary manufacturing method is proceeded to step S506: at least partially covering the first opening rebar net 10 by the second opening rebar net 20 of the rebar cage module 100, and hooking the second opening rebar net 20 on the plurality of third main bars 60 via the hanging portion 24 of the second opening rebar net 20 transversely. Specifically, as illustrated in FIG. 13, the second opening rebar net 20 is hooked on the plurality of third main bars 60 located on the second section 32 via the hanging portion 24, so that the second opening rebar net 20 and the first opening rebar net 10 may be covered with each other.

Figure 14:
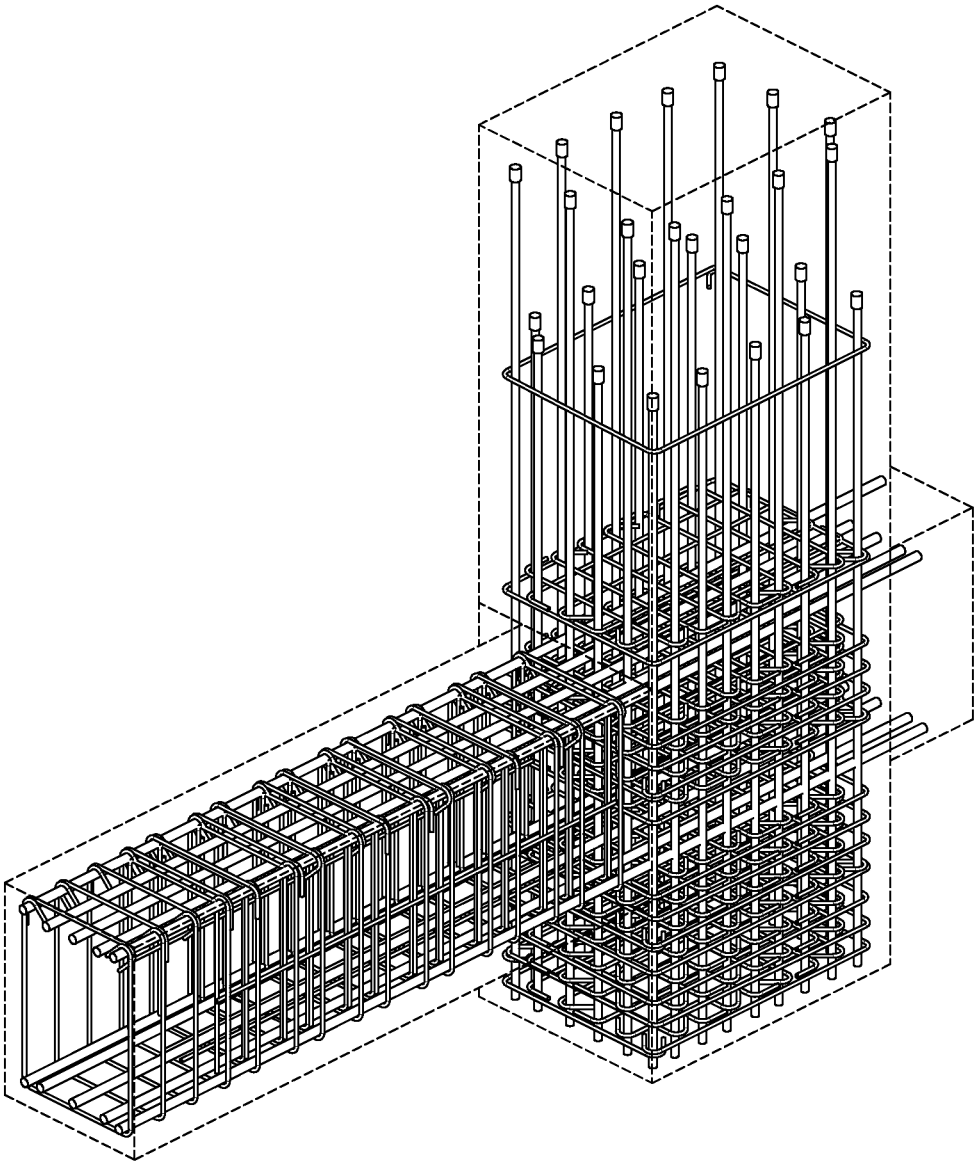
FIG. 14 shows the state in the main step 7 of the exemplary manufacturing method of the present invention.

Finally, the exemplary manufacturing method of the present invention is proceeded to step S507: providing a plurality of stirrup caps 70 on the second opening rebar net 20 and the stirrups 40. Wherein the stirrup caps 70 are provided corresponding to the openings. Specifically, the stirrup caps 70 will be provided corresponding to the stirrup openings 44 of the stirrups 40 and the second bottom rib 26 of the second opening rebar net 20. Finally, please refer to FIG. 14, illustrating a diagram of the completed beam reinforcement system of the present invention.

The first opening of the first opening rebar net and the second opening of the second opening rebar net for the beam reinforcement system of the present invention are covered with each other, so that it is more convenient to provide main bars so as to shorten the construction time of the exemplary manufacturing the rebar cage module.

The aforementioned embodiments of present invention can be modified by people skilled in the art, these modification does not exceed over the scope of the present disclosure disclosed in attached claims. Therefore, equivalent variations and modifications based on the contents of claims and specification of the present invention should belong to the scope of the present invention.

What is claimed is:

1. A rebar cage module, comprising:

an upper-opening rebar net having an upper opening, comprising:

a plurality of upper-opening rebars respectively arranged in parallel, wherein each of the upper-opening rebars includes:

a first erect bar portion having a first bend portion;

a second erect bar portion having a second bend portion and arranged in parallel with the first erect bar portion; and a first bottom rib extending from the first erect bar portion to the second erect bar portion;

a first traverse rib configured to connect one side of the plurality of upper-opening rebars;

a second traverse rib configured to connect the other side of the plurality of upper-opening rebar; and a third traverse rib configured to connect the plurality of upper-opening rebars and arranged in parallel with the first traverse rib;

a lower-opening rebar net having a lower opening oriented to a direction opposite to the upper opening, the lower-opening rebar net comprising:

a plurality of lower-opening rebars respectively arranged in parallel, the plurality of lower-opening rebars and the plurality of upper-opening rebars are disposed to be overlapped with each other, wherein each of the lower-opening rebars includes:

a third erect bar portion having a third bend portion;

a fourth erect bar portion having a fourth bend portion and arranged in parallel with the third erect bar portion; and a second bottom rib extending from the third erect bar portion to the fourth erect bar portion;

a fourth traverse rib configured to connect one side of the plurality of lower-opening rebars; and a fifth traverse rib configured to connect the other side of the plurality of lower-opening rebars opposite to the fourth traverse rib, the fifth traverse rib and the fourth traverse rib arranged in parallel;

wherein the upper-opening rebars are disposed to be overlapped with the lower-opening rebars, and wherein the first erect bar portion reaches the third bend portion, the second erect bar portion reaches the fourth bend portion, the third erect bar portion reaches the first bend portion, and the fourth erect bar portion reaches the second bend portion.

2. The rebar cage module of claim 1, wherein the upper opening is formed at the end opposite to the first bottom rib.

3. The rebar cage module of claim 1, wherein the first erect bar portion, the first bottom rib, and the second erect bar portion are configured to form a first accommodating portion, the first accommodating portion is configured to receive at least one main bar.

4. The rebar cage module of claim 1, wherein the lower opening is formed at the and opposite to the second bottom rib.

5. The rebar cage module of claim 1, wherein the second bottom rib is configured to form a hanging portion, the hanging portion is configured to hook at least one main bar transversely.

6. The rebar cage module of claim 1, wherein each of the first traverse rib, the second traverse rib, and the third traverse rib is provided on an inner side of the upper-opening rebars; wherein each of the fourth traverse rib and the fifth traverse rib is provided on an outer side of the lower-opening rebars.

7. The rebar cage module of claim 1, wherein each of the first traverse rib and the third traverse rib is provided on an inner side of the upper-opening rebars; wherein the second traverse rib is provided on an outer side of the upper-opening rebars; wherein each of the fourth traverse rib and the fifth traverse rib is disposed on an inner side of the lower-opening rebars.

8. The rebar cage module of claim 1, wherein each of the first traverse rib and the third traverse rib is disposed on an inner side of the upper-opening rebars; wherein the second traverse rib is disposed on an outer side of the upper-opening rebars; wherein the fourth traverse rib is disposed on an outer side of the lower-opening rebars; wherein the fifth traverse rib is disposed on an inner side of the lower-opening rebars.

9. A manufacturing method of a beam reinforcement system, comprising the following steps:

providing two first main bars in parallel;

hanging a plurality of stirrups on the two first main bars, wherein the stirrups include two erect bar portions arranged in parallel and a bottom rib connecting bottom ends of the two erect bar portions;

providing the first opening rebar nets of the rebar cage module of claim 1 on the plurality of bottom ends;

providing a plurality of second main bars to the first accommodating portion via the first opening;

providing a plurality of third main bars in parallel corresponding to the first opening and arranged in parallel with the two first main bars;

at least partially covering the first opening rebar net by the second opening rebar net of the rebar cage module of claim 1 and hooking the second opening rebar net on the plurality of third main bars transversely; and providing a plurality of stirrup caps on the second opening rebar net and the stirrups; wherein the stirrup caps are disposed corresponding to the openings.

10. The manufacturing method of claim 9, wherein the beam reinforcement system comprises a first section and a second section connected with each other, the steps of hanging the rebar cage module comprises:

hanging a plurality of stirrups on the first section and the second section; and providing the rebar cage module on the second section.

* * * * *